United States Patent [19]

Bonaschi

[11] Patent Number: 4,590,776

[45] Date of Patent: May 27, 1986

[54] CONTROL DEVICE FOR THE SELECTION OF WEFT YARNS IN A WEAVING MACHINE

[75] Inventor: Antonio Bonaschi, Cilavegna, Italy

[73] Assignee: Comez S.p.A., Cilavegna, Italy

[21] Appl. No.: 554,361

[22] Filed: Dec. 22, 1983

[30] Foreign Application Priority Data

Apr. 28, 1983 [IT] Italy ..... 20825 A/83

[51] Int. Cl.[4] ..... D04B 23/00

[52] U.S. Cl. ..... 66/205; 66/207

[58] Field of Search ..... 66/203, 204, 205, 207

[56] References Cited

U.S. PATENT DOCUMENTS 4,285,217 8/1981 Mista et al. ..... 66/205

*Primary Examiner*—Ronald Feldbaum

*Attorney, Agent, or Firm*—Laff, Whitesel, Conte & Saret

[57] ABSTRACT

The invention pertains to the technical field of the knitting machines and it particularly relates to a control device for the selection of weft yarns.

The device of the invention comprises selective tensioning means consisting of movable plates individually integral to tie rods, as well as of electromagnets individually facing said movable plates and globally integral to a movable support approaching said plates and moving away therefrom provided with an alternate motion in synchronism with the movement of the needles of the respective knitting machine. Said electromagnets are individually excited according to a predetermined work program, by electronic circuits.

9 Claims, 8 Drawing Figures

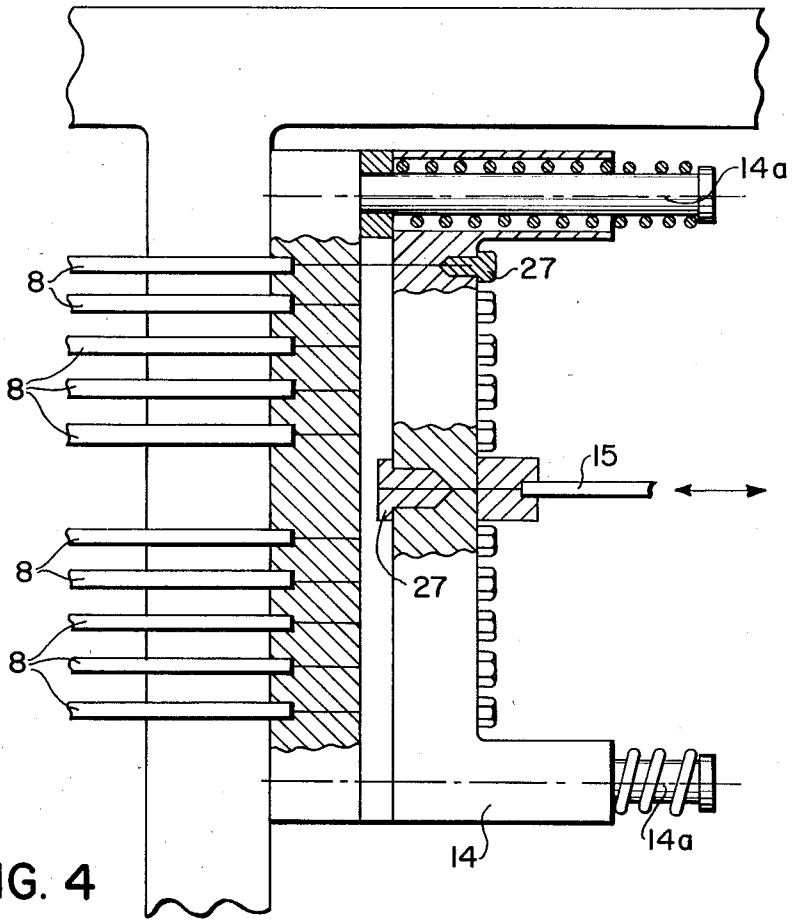
FIG. 4
FIG. 3
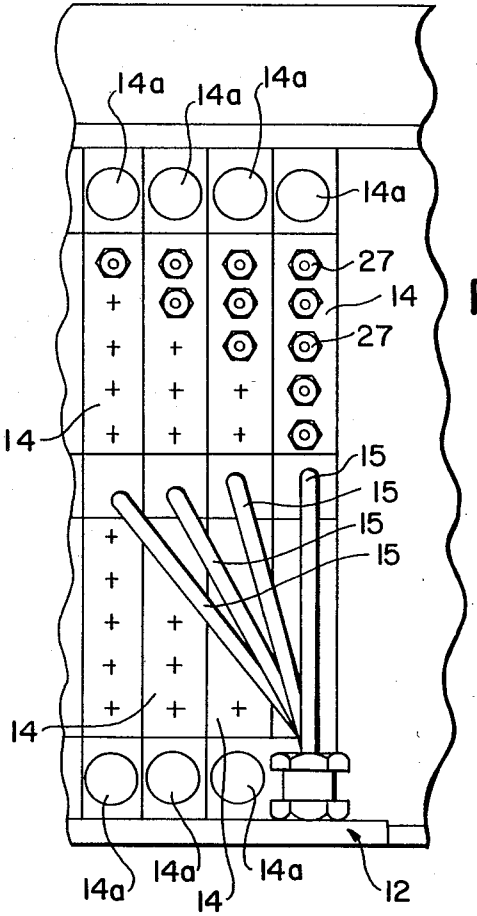

CONTROL DEVICE FOR THE SELECTION OF WEFT YARNS IN A WEAVING MACHINE

FIELD AND BACKGROUND OF THE INVENTION

The present invention relates to a control device for the selection of weft yarns in a knitting machine.

As it is known, there are knitting machines in which the control of weft yarns takes place by means of particularly complicated devices. A typical example can be found in the case of machines carrying a crochet-machine and a jacquard device on a single bearing frame.

The jacquard device controls the movement of the weft yarns and allows to obtain figured fabrics having very elaborated patterns. However, it requires the presence of selection and control members comprising hooked needles, a hooked needle trailing device, needles for the control of said hooked needles, as well as a selection drum that selects needles for the control of said hooked needles. In addition, said hooked needles act upon tie rods connected to rods that, by means of tubular weft yarn guides, control the feed of the weft yarn close to the needle-bar of a knitting machine.

Obviously such a unit is not only bulky and difficult to set up but it is expensive too and requires the constant employment of skilled operators.

It should be also noted that the selection drum for the needles controlling the hooked needles acts by way of a sheet or the like provided with holes for the possible introduction of the needles: so if even small faults are present the selection drum acts on the needles in an inexact manner.

OBJECTS

The technical task on which the present invention is based is therefore to accomplish a control device for the selection of weft yarns in a knitting machine suitable to eliminate the above mentioned drawbacks relating to the known art.

Within the scope of this technical task it is an important object of the present invention to accomplish a conrol device which, while being highly efficient and reliable, has a simple structure and consists of a comparatively reduced number of elements.

A further important object of the invention is to accomplish a device having reduced dimensions and therefore allowing the achievement of a compact knitting machine both in height and width.

A still further object of the invention is to accomplish a device that, after being previously and suitably arranged, does not need to be controlled by skilled persons.

SUMMARY OF THE INVENTION

These and still further objects that will become more apparent in the following are attained by a control device for the selection of weft yarns in a knitting machine, of the type in which yarns are supplied to the needles by means of tubular weft yarn guides supported by a crosspiece movable parallelly to a needle-bar, the movement of said tubular weft yarn guides with respect to said crosspiece being controlled by rods moved by tie rods connected in turn to a tensioning means for the selection of the same tie rods, characterized in that said selective tensioning means consists of a plurality of movable plates individually integral to said tie rods, and of a plurality of electromagnets individually facing said plates and globally integral to a movable support approaching said plates and moving away therefrom, provided with an alternate motion in synchronism with the movement of said needle-bar, said electromagnets being individually excited, according to a predetermined work program, by electronic circuits.

Further features and advantages will become more apparent from the description of a preferred but not exclusive embodiment of the invention, given hereinafter by way of example only, with reference to the accompanying drawings, in which:

BRIEF DESCRIPTION OF THE DRAWINGS

FIG. 3 is an enlarged fragment of the subject control device shown in the top portion of FIG. 2;

FIG. 4 is an enlarged fragment of the control device shown in FIG. 1 thereof;

DESCRIPTION OF THE PREFERRED EMBODIMENT

Figure 1:
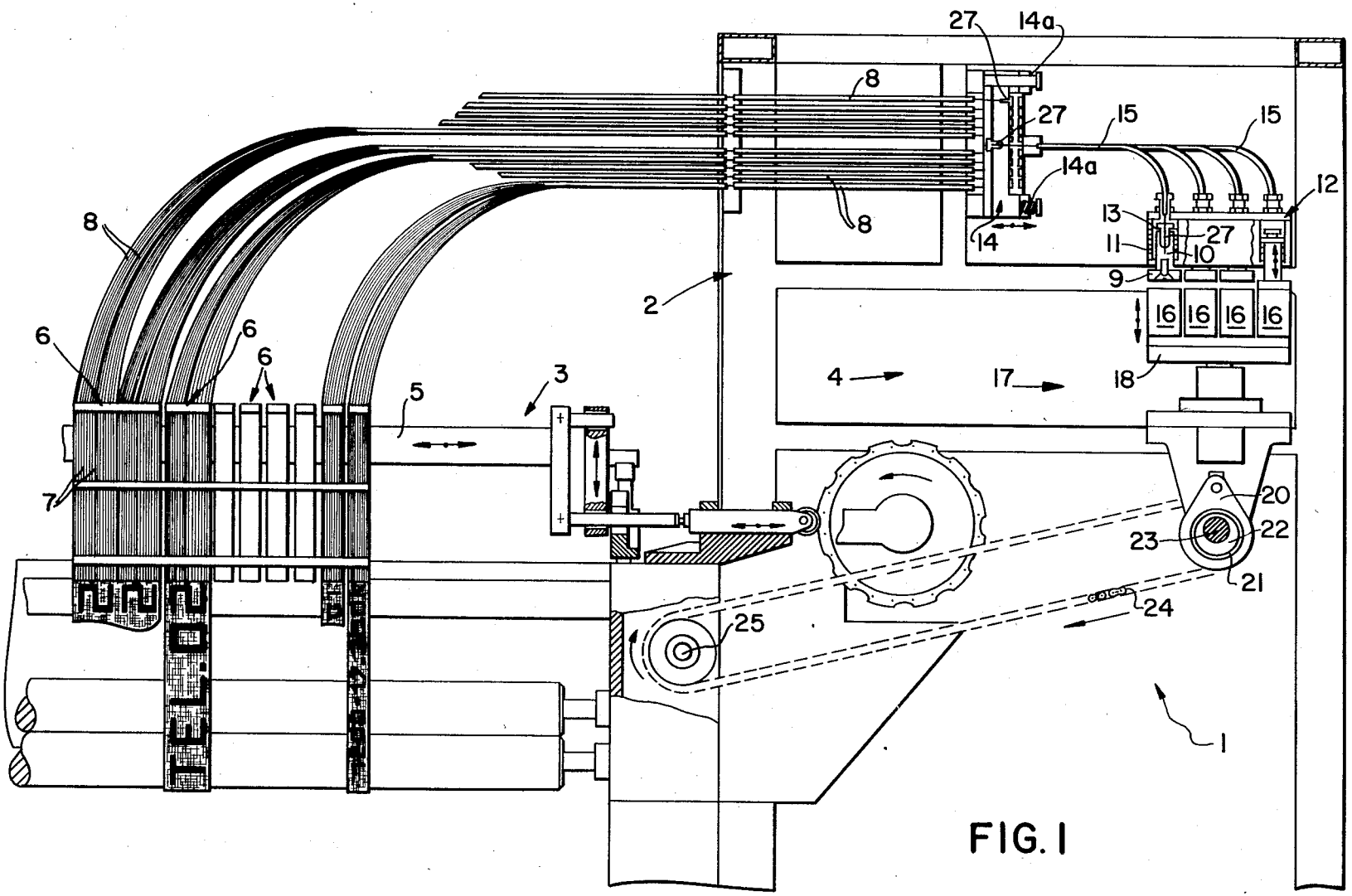
FIG. 1 is a diagrammatic elevation view of a knitting machine embodying the device according to the invention.

Referring to the drawings, a knitting machine generally indicated at 1 is shown therein. Said machine is provided with a frame 2 supporting, on one side, a crochet-machine 3 known in itself and, on the opposite side, the device of the invention 4.

The crochet-machine 3 is shown in FIG. 1 reference being particularly made to a crosspiece 5 movable parallelly to the machine needle-bar and carrying a plurality of plates 6, to each of said plates being connected, in known manner, a plurality of rods 7 movable with respect to the crosspiece 5 and supporting in turn tubular weft yarn guides disposed close to the machine needles. The oscillations of rods 7 are controlled by tie rods 8 connected to selective tensioning means suitably arranged in correspondence of the device 4.

The device 4, which is specifically the object of the present invention, is provided with a plurality of movable plates 9 that are indirectly connected to the tie rods 8. The movable plates 9 are substantially parallel to one another and provided with spigots 10 introduced in a movable manner into tubular chambers 11 obtained in a box-shaped envelope 12. The tie rods 8 reach the spigots 10 on the opposite part with respect to plates 9.

FIG. 1 also shows that spring means consisting of compression springs 13 are inserted into the tubular chambers 11 and tend to oppose the tensioning of tie rods 8. Advantageously, tie rods 8 are connected to plates 9 by means of spigots 10, through shaped members 14 and main tie rods 15.

The shaped members 14 can elastically oscillate on fixed guides 14*a* and are integral to tie rods 8 developing from rods 7. The main tie rods 15 connect the same shaped members 14 to spigots 10. The main tie rods 15 are secured to shaped members 14 centrally and the latter can oscillate on guides 14*a*, in opposition to spring means, so that they can follow the movements of the main tie rods 15 imposed by the movable plates 9.

Figure 2:
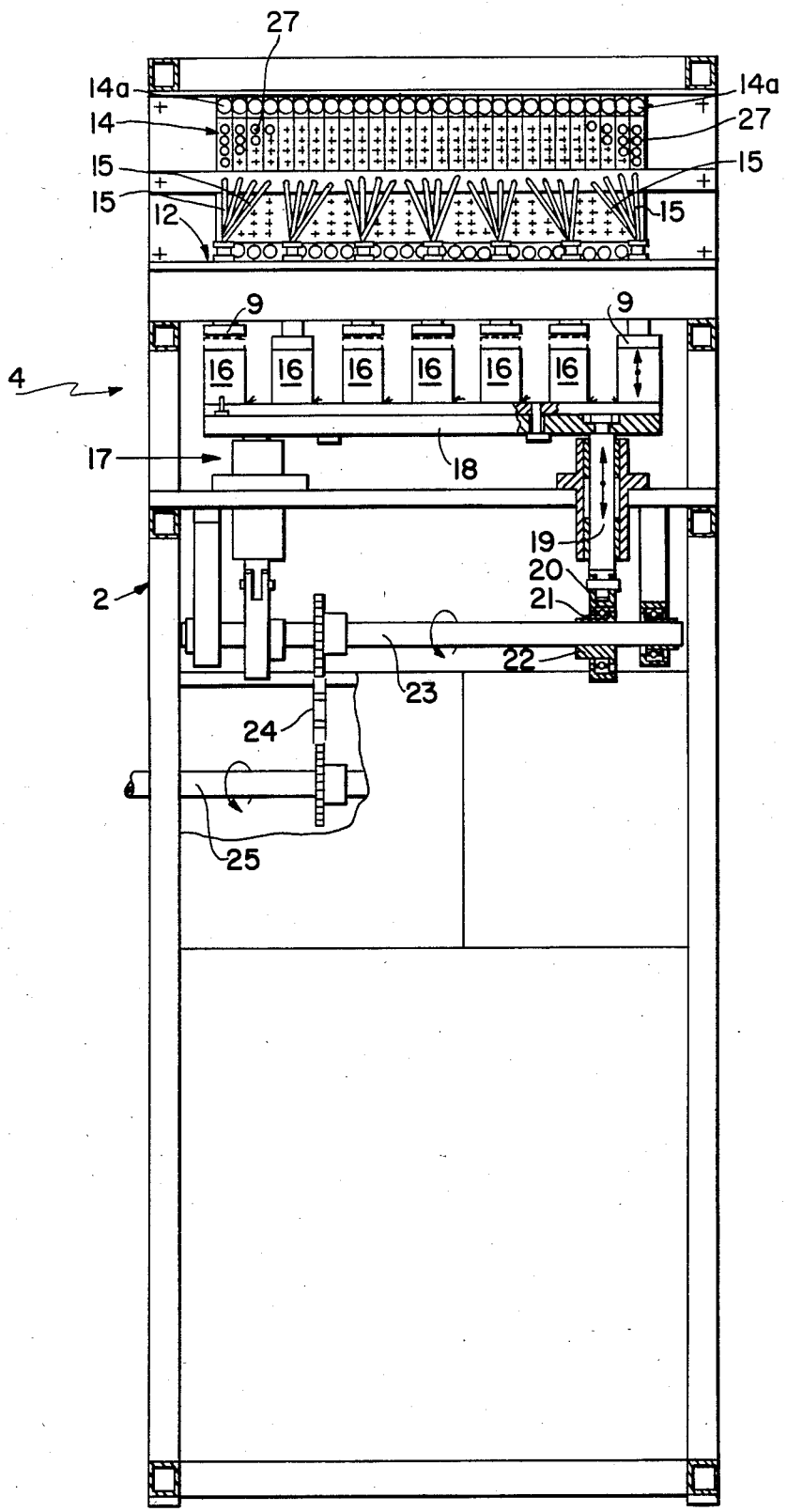
FIG. 2 is a side view of the machine shown in FIG. 1 in which the device of the invention is shown in more detail.
Figure 5:
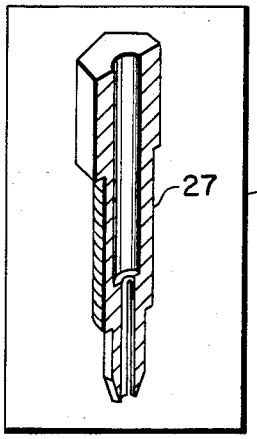
FIG. 5 is an enlarged perspective and partially cross-sectional view of the element 27 of the subject device.
Figure 6:
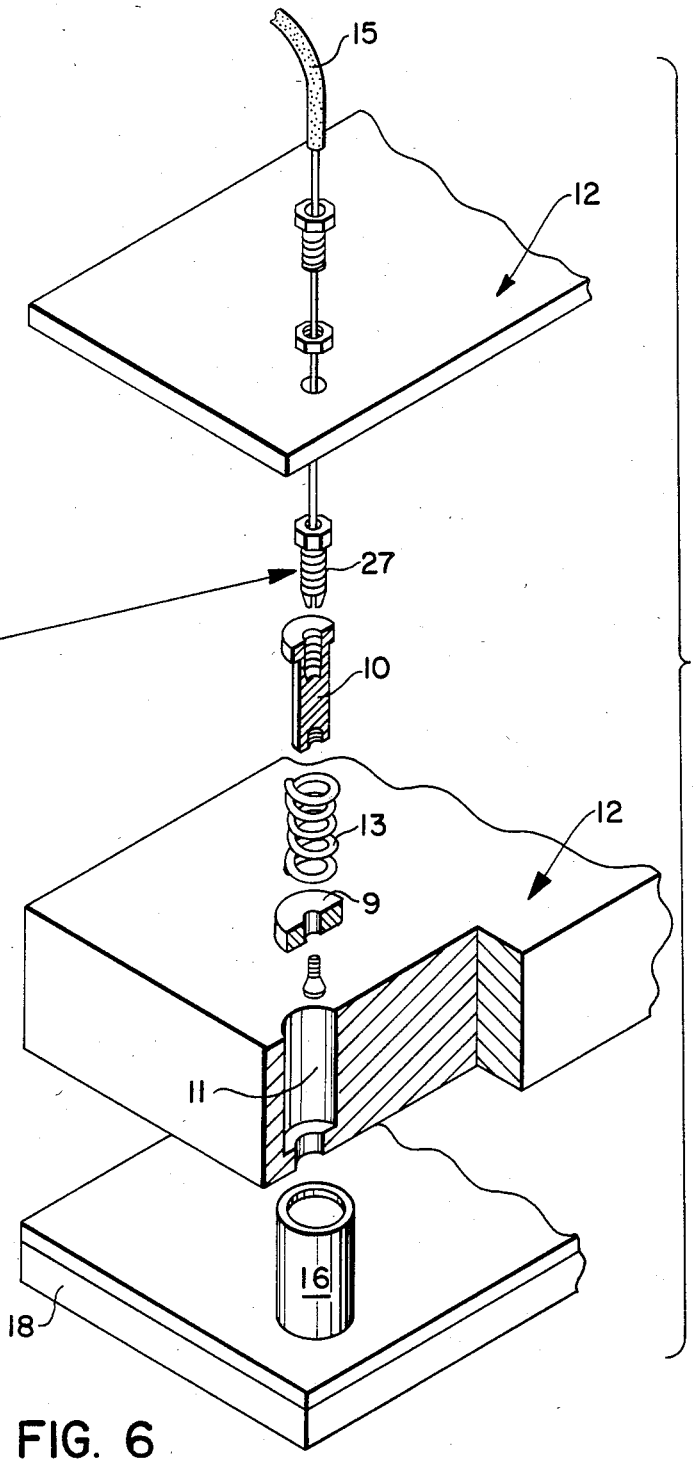
FIG. 6 is an enlarged perspective view of the linkage between elements 15 and 16 shown in the upper right portion of the device shown in FIG. 1.
Figures 7, 8:
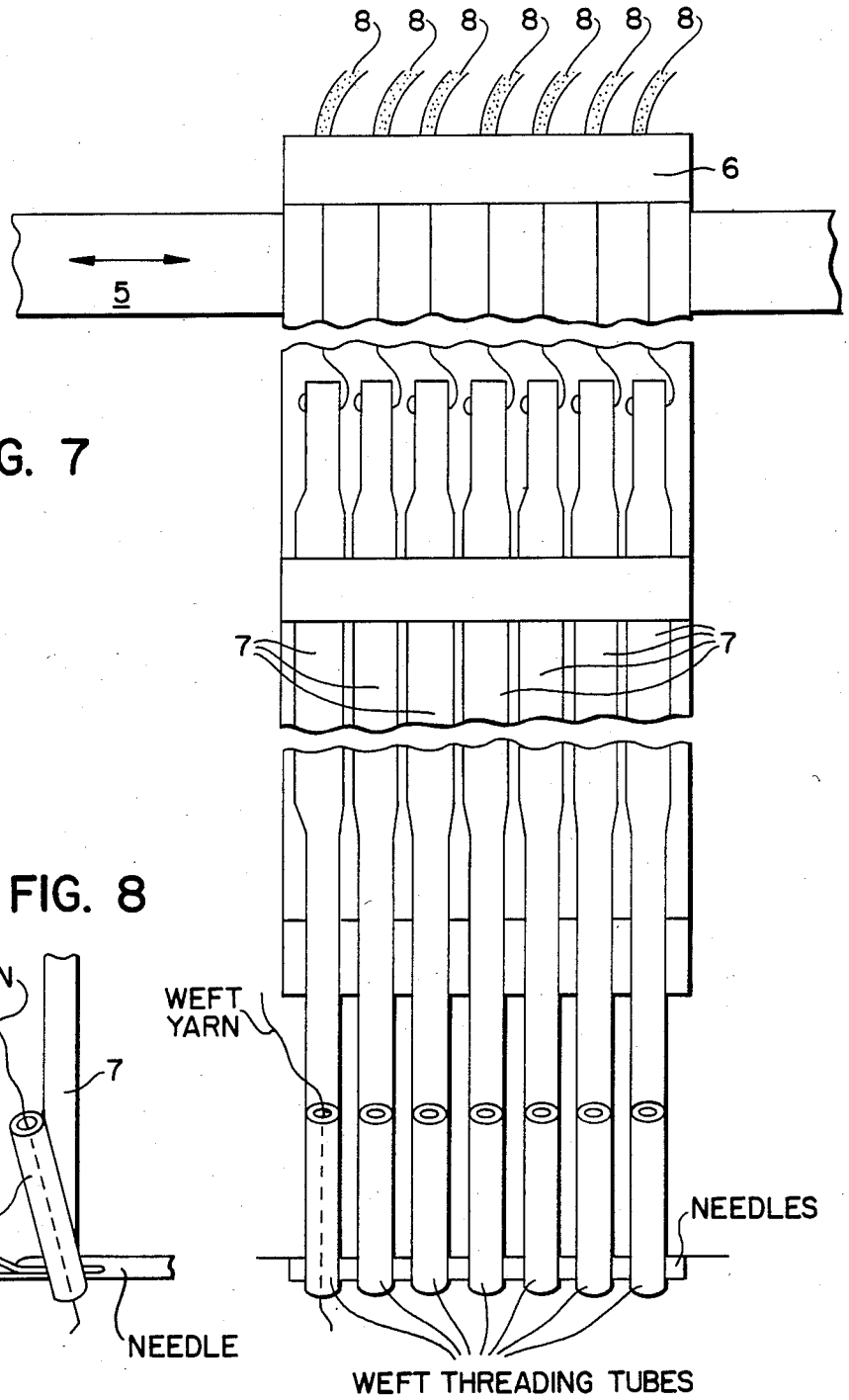
FIG. 7 is an enlarged prospective view of the elements 5, 6, 7 and 8 shown in the left portion of the device shown in FIG. 1.
FIG. 8 is an enlarged prospective view of a portion of FIG. 7.

FIG. 2 shows that, according to the technical solution disclosed, each main tie rod 15 controls a shaped element 14 engaged with ten tie rods 8, as seen in FIG. 1 too.

Facing the movable plates 9, provision is made for as many electromagnets as the plates themselves; said electromagnets are supported by a movable support 17 that, by its oscillation approaches said plates 9 or moves away therefrom, being provided with an alternate motion in synchronism with the movement of the needle-bar of the crochet machine 3.

As seen in FIG. 1 the movable support is defined by a platform 18 which by means of guided standards 19, is connected to oscillating annular members 20; the latter are crossed by cylinders 22 susceptible of rotating owing to the interposing of bearings 21, said cylinders being eccentrically fitted on a main shaft 23. The rotation of shift 23 is in turn controlled by a gear transmission means 24 connected to an auxiliary shaft 25 disposed in correspondence of the machine 3 and suitable to rotate in synchronism with the movement of the machine itself. FIG. 1 shows that a 1/1 gear ratio is provided between the auxiliary shaft 25 and the main shaft 23.

Like the movable plates 9, the electromagnets 16 are disposed on the platform 18 of the movable support 17 in rows. In the particular case shown rows of seven electromagnets (FIG. 2) and rows of four electromagnets (FIG. 1) are provided. Twenty-eight electromagnets 16 are therefore globally arranged and as many movable plates 9 and main tie rods 15 are provided.

In known manner, the electromagnets 16 are individually excited according to a predetermined work program coded for example by means of a card, by an electronic circuit not shown in the figures.

According to a feature of the invention, it is provided that preferably the tie rods 8 connected to the identical main tie rod 15 should be distributed one by one on different plates 6 and that the number of rods or tie rods 8 in correspondence of each plate 6 should be either equal to, or a multiple or a submultiple, of the number of the main tie rods 15. As a result, alternately, the same command of a main tie rod 15 is repeated many times, only once or less on each plate 6. In the embodiment shown each of the twenty-eight main tie rods 15 control ten tie rods 8 and the latter are connected to plates 6 provided with twenty-eight, fourteen or seven rods 7, for example.

The operation for the device according to the invention is as follows.

Platform 18 oscillates in a vertical direction in synchronism with the movement of the needles of the machine 3: by each alternate motion of the needle-bar it executes an alternate up and down movement. During the upward movement the electromagnets 16 approach plates 9, till the latter enter the area of influence thereof. However, only the electromagnets excited by said electronic circuits are able to exert their action and therefore only some movable plates 9 are entrained downwardly while the electromagnets 16 are moving downwardly. The descent of the movable plates 9 causes the respective main tie rods 15 to be tensioned, together with tie rods 8 connected to the same by means of the shaped members 14. In known manner the movement of tie rods 8 causes the weft yarns to be selected in the machine 3.

By each cycle are excited the electromagnets 16 necessary to achieve a particular result in correspondence of the needles of the machine 3. This result also depends on the manner in which the tie rods 8 of each shaped member 14 are distributed on plates 6. FIG. 1 shows that these tie rods are distributed so that it is possible to obtain as many strips provided with an individual pattern as the plates 6 are. The strips can have the same patterns with respect to each other or even different patterns. In any case if each tie rod 8 connected to a specific main tie rod 15 is alternated with a tie rod 8 of each main tie rod 15, patterns are repeated after a number of rods 7 equal to the number of the main tie rods 15. In the embodiment shown a tie rod 8 of a particular main tie rod 15 is followed by another tie rod 8 connected to the same main tie rod 15 after twenty-eight rods 7.

The invention thus attains the intended purposes. In fact a device has been performed that can control the selection of the weft yarn in a knitting machine in a simple and convenient manner. Using a reducing member of elements it is possible to obtain particularly different and diversified results. Furthermore, in order to achieve said results it is only necessary to insert punched cards into an electronic circuit or the like.

Obviously the invention as performed is susceptible of various modifications and variations and can be applied to machines of different types and also completed with further elements; furthermore other technical solutions can be adopted. For example in the figures it is shown that all tie rods 8 and main tie rods 15 are connected at their ends to locking means or cable terminals 27 consisting of a screw member having a central groove for inserting said tie rods and ending with a lobe-shaped cone portion so that when said cable terminals are screwed in the reciprocal approaching of the lobes provided on the cone-shaped end portion takes place and consequently the tie rods are locked.

All details can be replaced by technically equivalent elements. Practically materials used, shaped and sizes can be whatever according to the requirements.

What is claimed is:

1. A control device for the selection of weft yarns in a knitting machine, of the kind in which yarns are supplied to the needles by means of tubular weft yarn guides supported by a crosspiece movable parallelly to a needle-bar, the movement of said tubular weft yarn guides with respect to said cross-piece being controlled by rods moved by tie rods connected in turn to a selective tensionins means for the selection of the same tie rods, characterized in that said selective tensioning means consists of a plurality of movable plates individually integral to said tie rods, and of a plurality of electromagnets individually facing said plates and globally integral to a movable support approaching said plates and moving away therefrom, provided with an alternate motion in synchronism with the movement of said needle-bar, said electromagnets being individually excited, according to a predetermind work program, by electronic circuits.

2. A device according to claim 1, characterized in that said movable plates are essentially parallel to one another and provided with spigots introduced in a movable manner into tubular chambers obtained in a box-shaped envelope, and in that said tie rods reach said spigots on the opposite part with respect to said plates.

3. A device according to claim 1, characterized in that said plates are movable in opposition to spring means.

4. A device according to claim 1, characterized in that said movable support consists of a platform supported said electromagnets and movable by a rotary can, said cam being connected to the members of the knitting machine through gear transmission means.

5. A device according to claim 4, characterized in that said cam is defined by a cylinder eccentrically mounted on a main shaft and rotatably supporting, by means of a bearing, an annular member fitted on a guided standard connected to said platform.

6. A device according to claim 1, characterized in that said movable plates and said electromagnets are disposed in rows.

7. A device according to claim 1, characterized in that each movable plate is connected to a main tie rod integral to a plurality of said tie rods through an oscillating shaped member.

8. A device according to claim 7, characterized in that, in correspondence of said movable crosspiece, said rods are grouped in a plurality of plates and in that each of said tie rods connected to the same main tie rod is disposed on a different plate, the number of rods in each plate being equal to, or lower than, the number of said main tie rods.

9. A device according to any one of the preceding claims, characterized in that said tie rods are secured at their ends by means of cable terminals defined by screw members ending with a lobe-shaped cone portion, said portion being crossed by said tie rods and being countersunk when screwing takes place.

* * * * *